US010662681B2

(12) United States Patent
Fuchs et al.

(10) Patent No.: US 10,662,681 B2
(45) Date of Patent: May 26, 2020

(54) MOTOR VEHICLE LOCK COMPRISING A BRAKING PAWL AND A DRIVING DOG MECHANISM

(71) Applicant: Kiekert AG, Heiligenhaus (DE)

(72) Inventors: Carsten Fuchs, Essen (DE); Pavol Sedlar, Heiligenhaus (DE)

(73) Assignee: Kiekert AG, Heiligenhaus (DE)

( * ) Notice: Subject to any disclaimer, the term of this patent is extended or adjusted under 35 U.S.C. 154(b) by 241 days.

(21) Appl. No.: 15/521,378

(22) PCT Filed: Oct. 23, 2015

(86) PCT No.: PCT/DE2015/100445
§ 371 (c)(1),
(2) Date: Apr. 24, 2017

(87) PCT Pub. No.: WO2016/062308
PCT Pub. Date: Apr. 28, 2016

(65) Prior Publication Data

US 2017/0306658 A1 Oct. 26, 2017

(30) Foreign Application Priority Data

Oct. 24, 2014 (DE) ..... 10 2014 115 490

(51) Int. Cl.
*E05B 77/36* (2014.01)
*E05B 85/26* (2014.01)

(52) U.S. Cl.
CPC ..... *E05B 77/36* (2013.01); *E05B 85/26* (2013.01)

(58) Field of Classification Search
CPC ..... E05B 77/36; E05B 85/26
See application file for complete search history.

(56) References Cited

U.S. PATENT DOCUMENTS 8,480,138 B2 * 7/2013 Bendel ..... E05B 85/26 292/201
9,039,089 B2 * 5/2015 Ohba ..... B60N 2/2352 297/378.13

(Continued)

FOREIGN PATENT DOCUMENTS

CN 101542063 A 9/2009
DE 10 2004 048786 A1 4/2006

(Continued)

OTHER PUBLICATIONS

International Search Report and Written Opinion for corresponding Patent Application No. PCT/DE2015/100445 dated Mar. 10, 2016.

(Continued)

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

The aim of the invention is to provide a locking mechanism for a lock, which can be opened quietly. To achieve this aim, a lock is proposed comprising a locking mechanism with a rotary latch, a locking pawl for locking the rotary latch in a detent position and a braking pawl which initially can brake a rotary motion of the rotary latch that occurs after or during a movement of the locking pawl out of its detent position. Opening sounds can be reduced by means of this initial braking action. The lock also comprises a driving dog mechanism with a translatory action that can lift the braking pawl out of its braking position. This ensures that the braking pawl is moved out of its braking position in a reliable manner so that the lock can be opened.

17 Claims, 3 Drawing Sheets

(56) References Cited

U.S. PATENT DOCUMENTS

Figure 1:
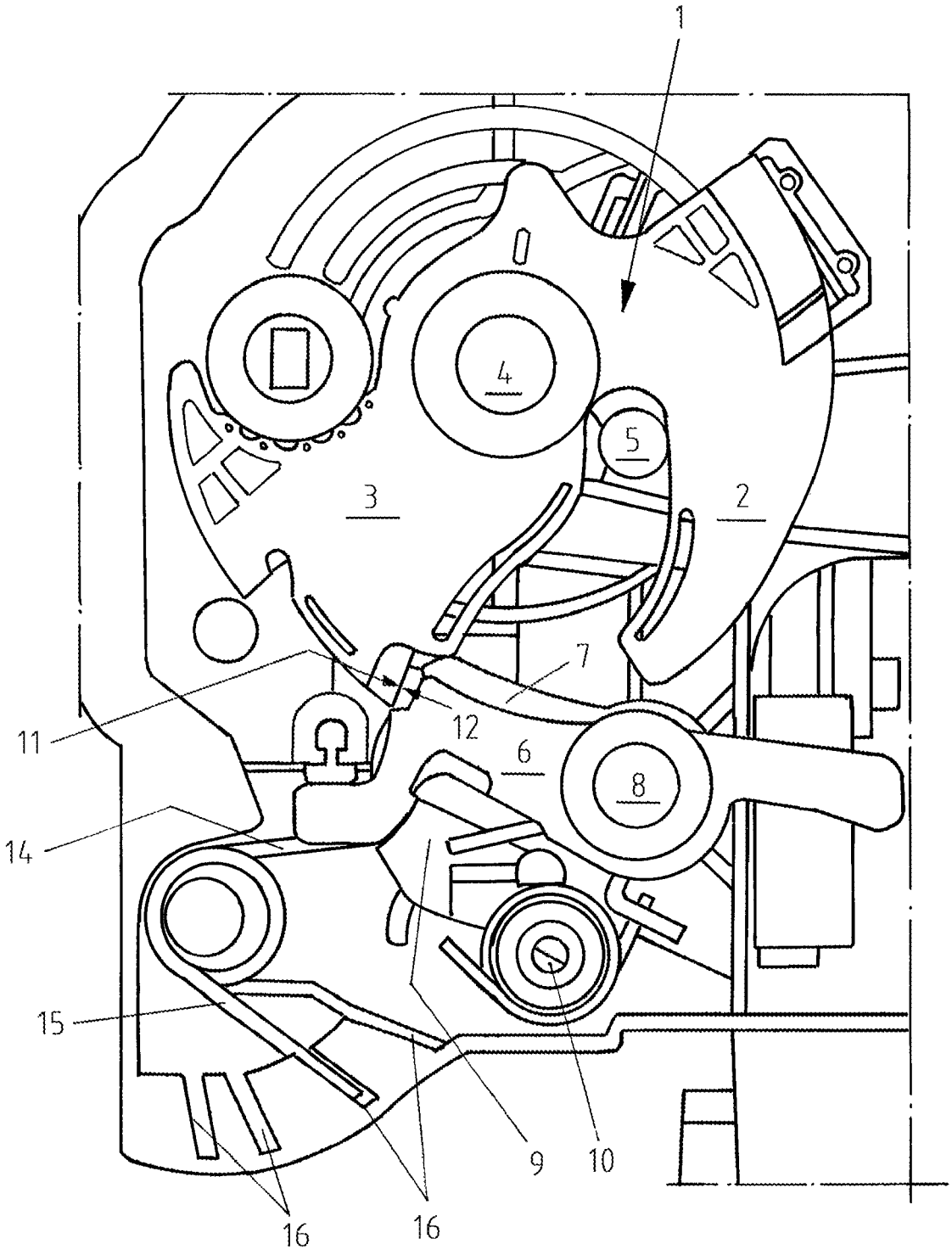

| | | | | |
|---|---|---|---|---|
| 2005/0062295 | A1* | 3/2005 | Ketelsen | E05B 85/26 292/216 |
| 2010/0052336 | A1 | 3/2010 | Bendel et al. | |
| 2013/0013163 | A1 | 1/2013 | Hong | |
| 2015/0337573 | A1* | 11/2015 | Schiffer | E05B 85/243 292/195 |

FOREIGN PATENT DOCUMENTS

| | | | |
|---|---|---|---|
| DE | 10 2007 003948 | A1 | 5/2008 |
| DE | 102009029031 | A1 | 3/2011 |
| DE | 10 2012 203731 | A1 | 1/2013 |
| DE | 102012011516 | A1 | 12/2013 |
| DE | 20 2012 011372 | U1 | 3/2014 |
| DE | 102013112569 | A1 | 5/2014 |
| JP | 2008-184843 | | 8/2008 |

OTHER PUBLICATIONS

English Translation of Office Action in counterpart Chinese Patent Application No. 2015800574009 dated Sep. 5, 2018.

Notice of Reasons for Rejection dated Jul. 2, 2019 issued in counterpart Japanese Application No. 2017-521990, and English Summary thereof.

* cited by examiner

MOTOR VEHICLE LOCK COMPRISING A BRAKING PAWL AND A DRIVING DOG MECHANISM

The invention relates to a latch for a motor vehicle with a locking mechanism and to a procedure for opening the locking mechanism.

A locking mechanism encompasses a pivotable catch to accommodate a locking bolt and a pawl, with which the catch can be ratcheted for locking. The metallic and/or plastic parts of the locking mechanism are generally pivotably mounted on a latch plate which is made of metal in principle.

The catch of a motor vehicle latch normally has a fork-shaped inlet slot formed by a load arm and a catching arm, into which the locking bolt of a motor vehicle door or a flap, for example a bonnet or a trunk lid enters when the door or flap is closed. The locking bolt then rotates the catch from an open position to a closed position. If the catch has reached the closed position, it is ratcheted via the pawl in this position. The locking bolt can then no longer leave the inlet slot of the catch.

Latch locking mechanisms for motor vehicles can be of such a construction that a locking moment is generated via the ratcheting which needs to be overcome with the aid of an actuating device to open the locking mechanism.

Locking moment means that the pawl cannot be moved out of its ratchet position due to a pressure exerted by the catch. The catch can then preferably initiate such a torque into the pawl that a force is exerted on the pawl in the direction of the ratchet position in order to ratchet with particular reliability. A pawl of such a locking mechanism is hereinafter referred to as a pawl with a locking moment.

If a pawl with a locking moment is pivoted out of its ratchet position, a lateral contour area of the catch glides over an adjacent lateral locking contour area of the pawl and is finally moved away via an edge of the pawl. If the lateral contour area of the catch glides over this pawl edge, the catch and the pawl are then accelerated greatly and abruptly. A noise occurs which is referred to as an opening plop.

In order to reduce an opening plop a pawl with an initial locking moment, the locking contour of which runs in such a way that during opening an opening moment is subsequently initiated by the catch into the pawl, is proposed in DE 10 2009 029 031 A1. However, if the pawl is moved out of its ratchet position at greater speed, the catch is not or is not immediately adjacent to the contour area which causes an opening moment. An opening plop can then not be prevented.

Hereinafter, a latch, for example a pawl with an opening moment is understood to mean a catch in which the latch is capable of initiating an opening moment by pressure by means of which the latch can be moved out of its position. A pawl with an opening moment is known from DE 10 2007 003 948 A1.

The task of the invention is to create a locking mechanism for a latch which can be opened quietly.

In order to solve the task, a latch encompasses a locking mechanism with a catch, a pawl for ratcheting of the catch in a ratchet position and a brake latch which can initially brake a rotational movement of the catch occurring after or during movement of the pawl out of its ratchet position. This initial braking reduces opening noises. The latch also encompasses a towing arm mechanism with transmission which can lift the brake latch out of its braking position. This ensures that the brake latch can be reliably moved out of its braking position for opening of the latch.

Unless stated otherwise hereinafter, the object of the invention can encompass one or several of the aforementioned characteristics in any combination.

Transmission means that the towing arm mechanism transmits an angle of rotation of a latch into another angle of rotation of another latch, whereby both angles of rotation are in a determined, differing ratio to one another. Advantageously, for a pivoting of the brake latch an envisaged latch does not need to be pivoted in the same manner in order to achieve a suitable construction. Transmission can be achieved by a gearbox or a lever mechanism.

The transmission is advantageously configured in such a way that an angle of rotation of the envisaged latch is transmitted into a larger angle of rotation of the brake latch. A relatively small pivoting movement of the envisaged latch is then advantageously sufficient to move the brake latch out of its braking position.

Advantageously, the transmission is at least 2:1, preferably at least 4:1. Such transmissions can be achieved with sufficiently small installation space.

In principle, in the ratcheted position the brake latch is adjacent to the catch in order to prevent the occurrence of opening noises in a further improved manner. However, it can also be sufficient to bring the brake latch into its braking position subsequently or during lifting of the pawl.

In principle, the catch can initiate an opening moment into the brake latch during braking. This is associated with the advantage that the catch is capable of moving the brake latch out of its braking position by rotating in the opening direction. The pawl is initially moved out of its ratchet position for opening of the locking mechanism. If the pawl has been moved out of its ratchet position, the catch is adjacent to the brake latch. This therefore prevents either the catch or the pawl being accelerated greatly and abruptly. Instead, following lifting of the pawl out of its ratchet position, the catch then moves the brake latch out of its braking position which is comparatively quiet. In this design, the towing arm mechanism only moves the brake latch out of its braking position in principle when the moving out is not sufficient on the basis of the opening moment, for example due to a defect.

Overall, a latch is available which can be opened especially quietly compared to customary latches and is capable of being opened and closed reliably. This applies especially to latches with a pawl with a locking moment. However, the pawl can also be a pawl with an opening moment.

In one design, the aforementioned envisaged latch is the pawl in order to minimize the number of components. In particular, it is then advantageous that a small rotational movement with a small angle of rotation is sufficient to enable the brake latch to execute a pivoting movement with a larger angle of rotation by means of the towing arm mechanism. This is because, firstly, a small actuation movement is advantageously sufficient to reliably open the latch. Secondly, it is then possible to initially be able to move the pawl out of its ratchet position without the towing arm mechanism on the one hand immediately also pivoting the brake latch and on the other hand the pawl overall needing to be pivoted with an excessively large angle of rotation starting from its ratchet position in order to move the brake latch out of its braking position.

In one design, the towing arm mechanism encompasses a deflection lever which transmits a pivoting movement of the envisaged latch, in particular a pawl, into a pivoting movement of the brake latch. With little installation space, a regularly well-suited transmission can regularly be obtained in the dimension of, for example 2:1, 3:1, 4:1 or also 5:1.

In one design of the invention, from towing by a towing arm mechanism a pivoting movement of the envisaged lever from 3° to 7°, preferably from 4° to 6° is sufficient to move the brake latch completely out of its braking position by means of the towing arm mechanism.

In one design of the invention, the brake latch is made of plastic. This advantageously reduces the weight and the manufacturing cost and also contributes in a further improved manner to reducing the opening noises.

In one design of the invention the pawl is completely or at least predominantly made of metal. It is thus ensured that the locking mechanism can cope with the mechanical stresses which can occur during the operation of a motor vehicle in the ratcheted state.

In one design of the invention, the pawl is thicker than the brake latch. In a further improved manner, it is ensured that the locking mechanism is reliably able to cope with mechanical stresses in the ratcheted state without the need for an excessive increase in weight, installation space and manufacturing cost. The pawl is therefore preferably at least twice as thick as the brake latch.

In one design of the invention, the pawl and the brake latch are pivotably accommodated coaxially. This also reduces the installation space, the weight and the manufacturing cost.

In one design of the invention, the catch is predominantly at least as thick as the pawl and/or thinner than the overall thickness of the pawl and the brake latch.

In one execution form, the area of the locking contour of the catch is thicker compared to the aforementioned thickness of the catch in such a way that in this area both latches, i.e. pawl and brake latch, can be adjacent for ratcheting or braking. This design contributes in a further improved manner to ensure that the locking mechanism is reliably able to cope with mechanical stresses without an excessively great weight and material costs.

In one design, the brake latch is pre-tensioned by a spring in the direction of the braking position. Hereby, the braking force can be suitably reinforced to enable especially quiet opening. This design constitutes an independent invention.

In an advantageous design, pre-tensioning of the spring can be adjusted. The braking force can be advantageously individually adjusted to the respective installation situation.

In one design of the invention, the spring with which the brake latch is pre-tensioned is a leg spring. Furthermore, there are a number of mountings to hold the leg of the leg spring. The other leg of the spring lies adjacent to the brake latch in a pre-tensioned manner. It is hereby possible to adjust the pre-tensioning of the spring and thus the braking force. A thread element, thus for example a screw, can be present to adjust the pre-tensioning of the spring. One end of the spring is then adjacent to the thread element. Adjustment of the thread element then changes the pre-tensioning.

In one design of the invention, the catch is pre-tensioned by a spring in the direction of the opening position. The pre-tensioning of the spring is such that the braking force cannot be overcome by means of the brake latch solely by the pre-tensioning of the spring. A door sealing pressure must first be added in order to move the brake latch out of its braking position without assistance from the towing arm mechanism. The braking force is therefore relatively high which enables especially quiet opening. Should a door sealing pressure prove insufficient, at least a forced towing of the brake latch takes place to reduce the opening noise.

The initial cut of the brake contour or braking surface of the pawl is designed in principle in such a way that an opening moment occurs to reduce the opening noise from the triggering point to the pivoting out of the brake latch. The corner radius or transitional radius of the locking contour is advantageously >0.8 mm in order to improve the force outline and the opening acoustics especially greatly.

The invention is described in greater detail on the basis of figures hereinafter.

Figure 2:
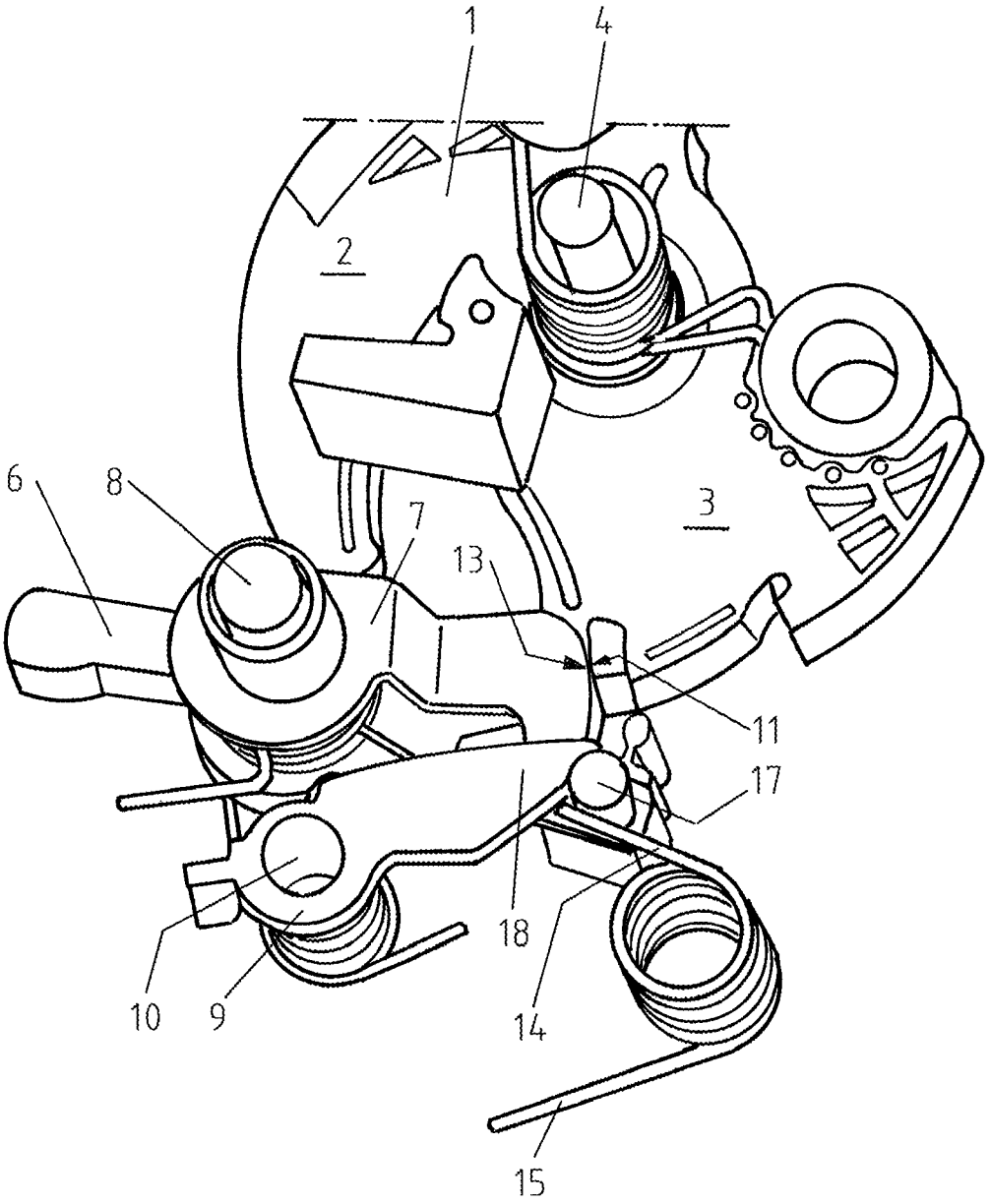
Figure 3:
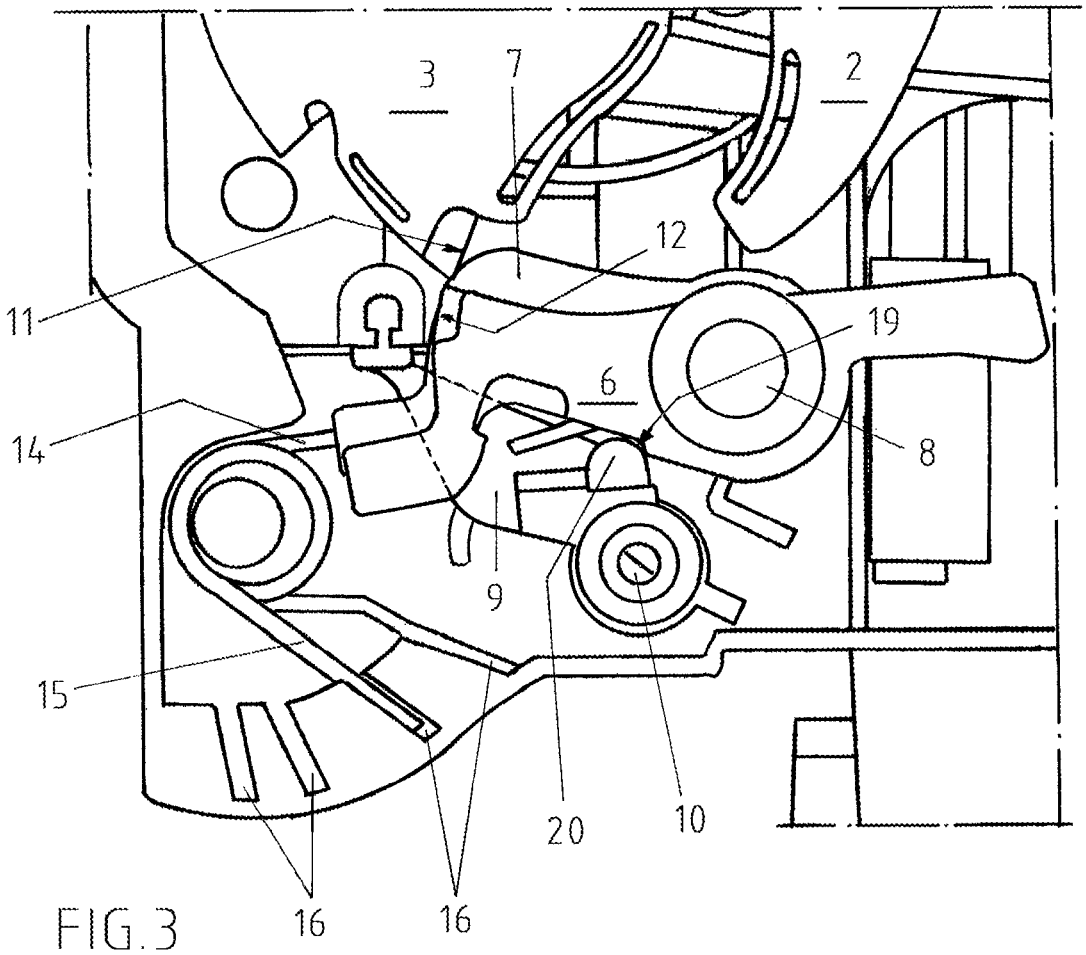
Figure 4:
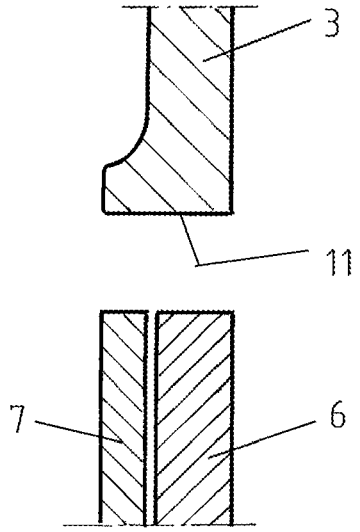

The following are shown:

FIG. 1: A top view of the locking mechanism in the ratcheted state;

FIG. 2: locking mechanism in a perspective view;

FIG. 3: locking mechanism during an opening process;

FIG. 4: cut through catch, pawl and brake latch in the area of the locking surfaces/braking surface.

A catch 1 with a load arm 2 and a catching arm 3 is shown in FIG. 1. The catch 1 can be rotated around its axis 4. In the ratcheted state, a locking bolt 5 cannot leave the catch 1. The catch 1 can be ratcheted by means of a pawl 6 as shown in FIG. 1. A brake latch 7 is located behind the pawl 6. Both latches 6 and 7 are pivotably accommodated coaxially 8. The latch furthermore demonstrates a deflection lever 9 which is capable of transmitting a pivoting movement of the pawl 6 to the brake latch 7. The deflection lever 9 is a towing arm mechanism with transmission. The deflection lever 9 is pivotably accommodated by an axis 10.

In the ratcheted state, the locking surface 12 of the pawl 6 is adjacent to the locking surface 11 of the catch 1 as shown in FIG. 1. At the same time, behind this the brake latch 7 with a braking surface 13 (see FIG. 2) lies adjacent to the locking surface 11 of the catch 1 lies.

A spring leg 14 of a spring is adjacent to the brake latch 7 in such a way that the brake latch 7 can be moved by spring force in the direction of its braking position. The other leg 15 of this spring is located in a mounting 16, of which a number are envisaged to be able to adjust the pre-tensioning of the spring with the spring legs 14 and 15.

FIG. 2 shows the illustration from FIG. 1 from the rear in a perspective view. FIG. 2 illustrates the adjacency of the braking surface 13 to the locking surface 11 of the catch 1. Furthermore, FIG. 2 illustrates that the lever 9 is adjacent with its lever end 18 to a bolt 17 at the end of the brake latch 7. Furthermore, the spring leg 14 is adjacent to the bolt 17 in such a way that the brake latch 7 is pressed in the direction of its braking position. FIG. 2 shows that the area of the locking surface 11 of the catch 1 is broadened compared to the remaining thickness of the catch 1 (see also FIG. 4). This ensures that the brake latch 7 and the pawl 6 can simultaneously lie adjacent to the locking surface 11 of the catch without the catch 1 overall needing to be executed with relevant thickness. This helps to minimize the material consumption and the weight.

FIG. 3 shows the start of the triggering process or opening of the latch. The pawl 6 has been pivoted a few degrees around its axis 8 in a counter-clockwise direction. The pawl 6 has left its ratchet position. A lateral contour area 19 of the pawl 6 has thus reached a protruding bolt 20 of the deflection lever 9. The pawl 6 has therefore been moved out of its ratchet position without transmitting a pivoting movement to the brake latch 7.

The locking surface 11 of the pawl 1 is now only adjacent to the braking surface 13 of the brake latch 7. As the catch 1 initiates an opening moment into the brake latch 7, with sufficiently great torque the brake latch 7 is now also moved out of its braking position against the force of the spring 14, 15. In principle, the force of a pre-tensioned spring which pre-tensions the catch 1 in the direction of the opening position is not sufficient for this purpose. Firstly, a sufficiently great door sealing pressure needs to be added. As the catch 1 due to the brake latch 7 is not accelerated abruptly but comparatively slowly, opening noises are prevented.

If, for example, a door sealing pressure is not sufficient due to signs of fatigue, in order to initiate a sufficiently great torque by means of the catch 1 into the brake latch 7, the towing arm mechanism becomes effective in which the pawl is rotated further in a counter-clockwise direction. Hereby, the transmission lever 9 is now pivoted around its axis 10 also in a counter-clockwise direction.

The lever end 18 of the transmission lever then moves the bolt 17 and thus pivots the brake latch 7 out of its braking position. The transmission ratio is 4:1. It is therefore sufficient to pivot a pivoting of the pawl 6 by only 5°, around the brake latch 7 by 20°. With a relatively small additional pivoting movement of the pawl 6 the brake latch 7 can therefore be moved completely out of its braking position by means of the transmission lever 9. Subsequently, the catch 1 can be pivoted into its open position and the locking bolt 5 can leave the latch or the locking mechanism of the latch.

FIG. 4 illustrates the broadening of the catch 1 in a sectional view in the area of the locking surface 11 in addition to the adjacent areas of the brake latch 7 and the pawl 6.

REFERENCE SIGN LIST

1. Catch
2 Load arm
3. Catching arm
4 Catch axis
5 Locking bolt
6 Pawl
7 Brake latch
8 Axis for the pawl and the brake latch
9. Deflection lever
10 Axis of the deflection lever
11 Locking surface of the catch
12 Locking surface of the pawl
13 Braking surface of the brake latch
14 Spring leg for brake latch
15 Spring leg
16 Mounting for spring leg
17 Bolt
18 Lever end

The invention claimed is:

1. A latch comprising:

a locking mechanism having a catch for receiving a locking bolt, and a pawl for ratcheting of the catch in a ratchet position of the locking mechanism, wherein the catch has a catch locking surface and the pawl has a pawl locking surface that is engaged against the catch locking surface when in the ratchet position and is moved away from the catch locking surface during movement of the locking mechanism out of the ratchet position, a brake latch which is capable of braking a rotational movement of the catch during lifting or following lifting of the pawl to move the locking mechanism out of the ratchet position, the brake latch having a braking surface that is engaged against the catch locking surface and adjacent to the pawl locking surface when the locking mechanism is in the ratchet position, whereby the braking surface and the pawl locking surface are in contacting engagement against the same catch locking surface when the locking mechanism is in the ratchet position, the braking surface being engaged against the catch locking surface during movement of the locking mechanism out of the ratchet position; and a towing arm mechanism configured to transmit a pivoting movement into a pivoting movement of the brake latch, whereby the brake latch is moved out of a braking position.

2. The latch according to claim 1, wherein the towing arm is attached on the pawl.

3. The latch according to claim 1, wherein the brake latch is made of plastic.

4. The latch according to claim 1, wherein the brake latch is thinner than the pawl.

5. The latch according to claim 1, wherein the pawl is at least predominantly made of metal.

6. The latch according to claim 1, wherein the catch is at least as thick as the pawl.

7. The latch according to claim 1, wherein the catch is at least predominantly thinner than the overall thickness of the brake latch and the pawl.

8. The latch according to claim 1, wherein the catch is thicker in the area of its locking surface compared to the remaining thickness.

9. The latch according to claim 1, wherein the pawl and brake latch are pivotably accommodated coaxially.

10. The latch according to claim 1, wherein the radius of the braking surface of the brake latch is greater than 0.8 mm.

11. The latch according to claim 1, wherein the catch is configured to receive a locking bolt ratcheting the catch when the locking mechanism is in the ratchet position.

12. The latch according to claim 1 further comprising a pre-tensioned spring engageable with brake latch, wherein pre-tensioning of the spring can be adjusted.

13. The latch according to claim 12, wherein a number of mountings are present for mounting of a leg of the spring.

14. The latch according to claim 12, wherein the spring is engageable with a bolt of the brake latch.

15. A method for opening the locking mechanism according to claim 1, the method comprising:

initially moving the pawl to move the locking mechanism out of the ratchet position by actuation of an actuation device; and subsequently moving the brake latch out of the braking position by the catch.

16. The latch according to claim 1, wherein the pawl includes a lateral contour area that is engageable against a protruding bolt of the towing arm mechanism.

17. The latch according to claim 1, wherein the towing arm mechanism is pivotable to engage the brake latch to move the braking surface of the brake latch out of engagement with the catch locking surface.

* * * * *